US005590910A

United States Patent [19]

Meth

[11] Patent Number: 5,590,910

[45] Date of Patent: Jan. 7, 1997

[54] COLLAPSIBLE ALL-WEATHER CLIPBOARD ASSEMBLY

[76] Inventor: Marc R. Meth, R.R. 1 Box 1527-38, Manchester Center, Vt. 05255

[21] Appl. No.: 497,799

[22] Filed: Jul. 3, 1995

[51] Int. Cl.[6] ..... B42D 3/00

[52] U.S. Cl. ..... 281/45; 281/51

[58] Field of Search ..... 281/45, 51, 28, 281/42; 248/444.1; 24/67, 67.5, 67 R; 402/4, 70, 73, 80 R

[56] References Cited

U.S. PATENT DOCUMENTS

| | | | |
|---|---|---|---|
| 1,133,979 | 3/1915 | Lee . | |
| 1,642,384 | 9/1927 | Pryor . | |
| 1,642,385 | 9/1927 | Pryor . | |
| 1,967,632 | 7/1934 | Simonson . | |
| 2,547,167 | 4/1951 | Nielsen . | |
| 3,848,547 | 11/1974 | Schaefer | 109/49.5 |
| 4,445,728 | 5/1984 | Bratton | 312/1 |
| 4,997,088 | 3/1991 | Spry | 206/449 |

FOREIGN PATENT DOCUMENTS

| | | | |
|---|---|---|---|
| 2140350 | 11/1984 | United Kingdom | 281/51 |

*Primary Examiner*—Frances Han
*Attorney, Agent, or Firm*—Dowell & Dowell

[57] ABSTRACT

A clipboard assembly which can be used in all weather conditions provides a box-like inclement weather five-sided protective cover configuration for protecting writing media held by the board's clip, and a compact and generally planar collapsed configuration for use during good weather and indoors, and also for storage. When the all-weather clipboard assembly is in the inclement weather configuration, a top planar member covers the writing media from above, and one side of the protective cover is left open to provide access to any writing materials engaged by the clip. When the clipboard assembly is in the collapsed, good weather position, a pair of opposed walls of the protective cover fold under the top planar member, and an end wall folds down to form a new planar writing surface comprised of the top surface of the planar cover member and the outer surface of the end wall.

20 Claims, 2 Drawing Sheets

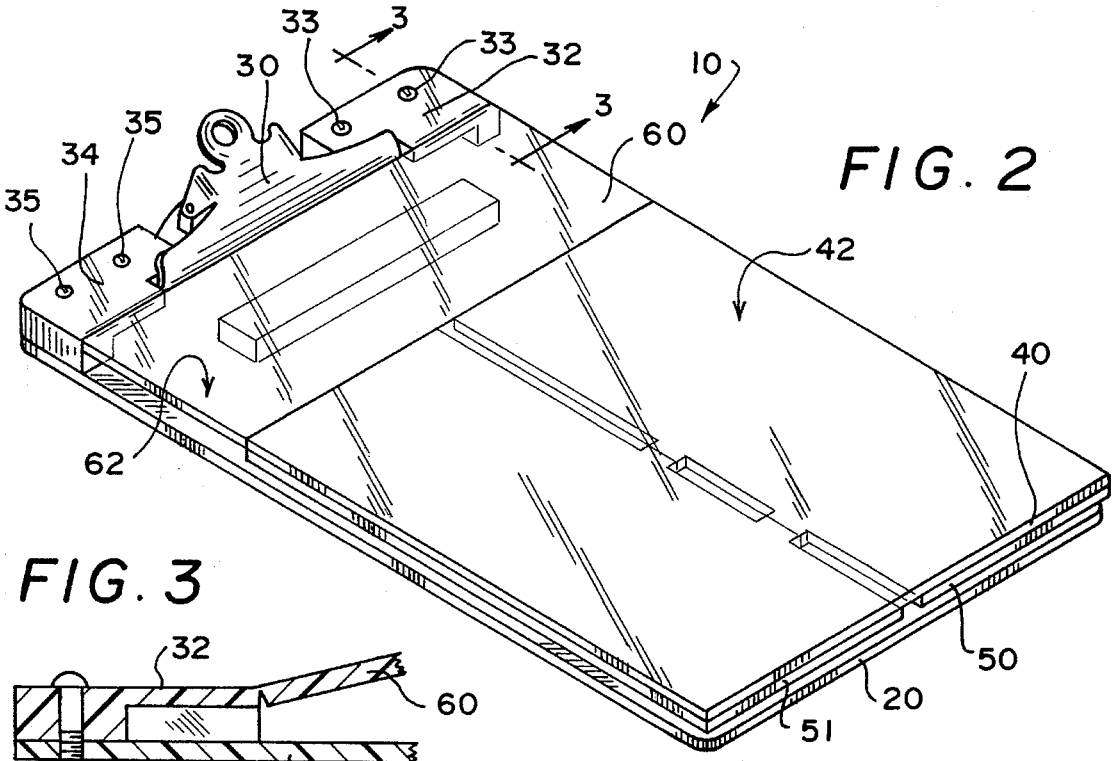
FIG. 2
FIG. 3
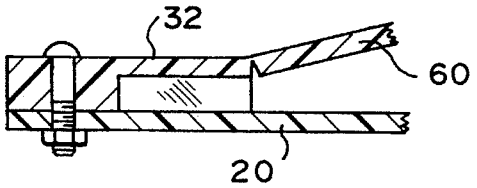
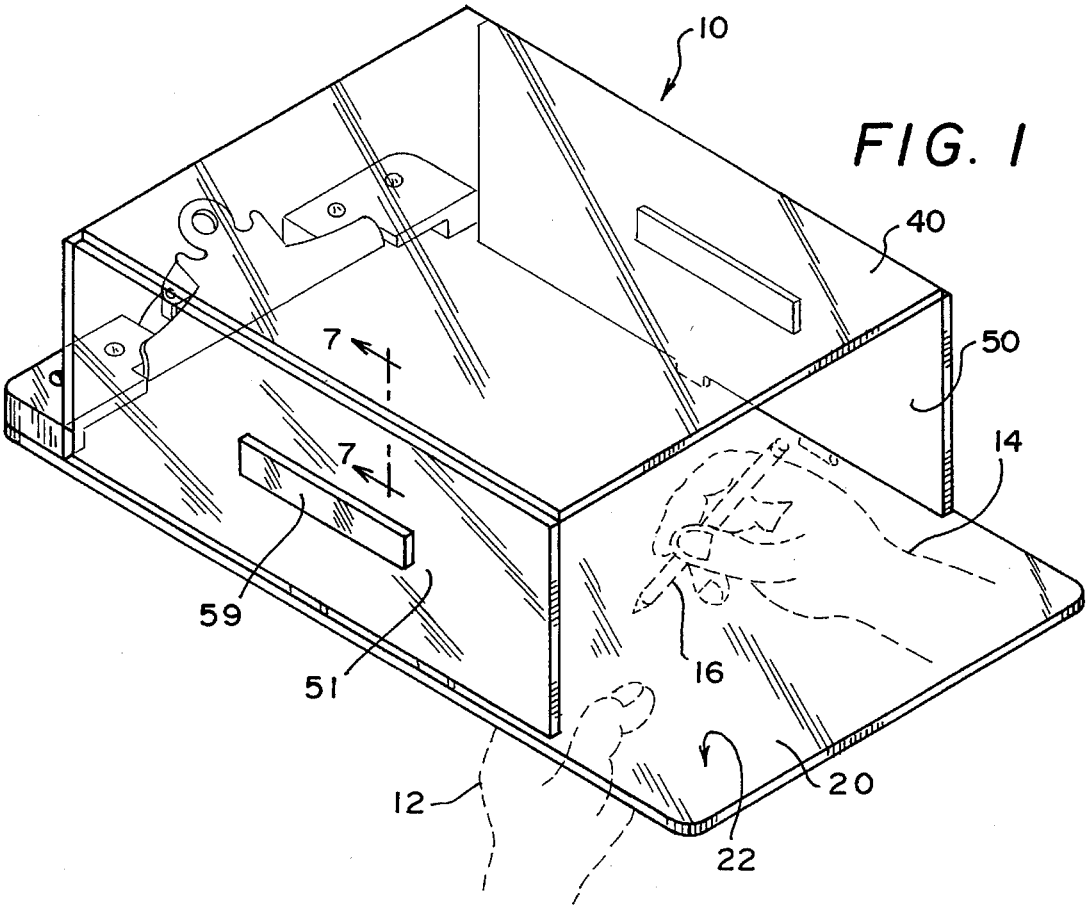
FIG. 1

FIG. 4
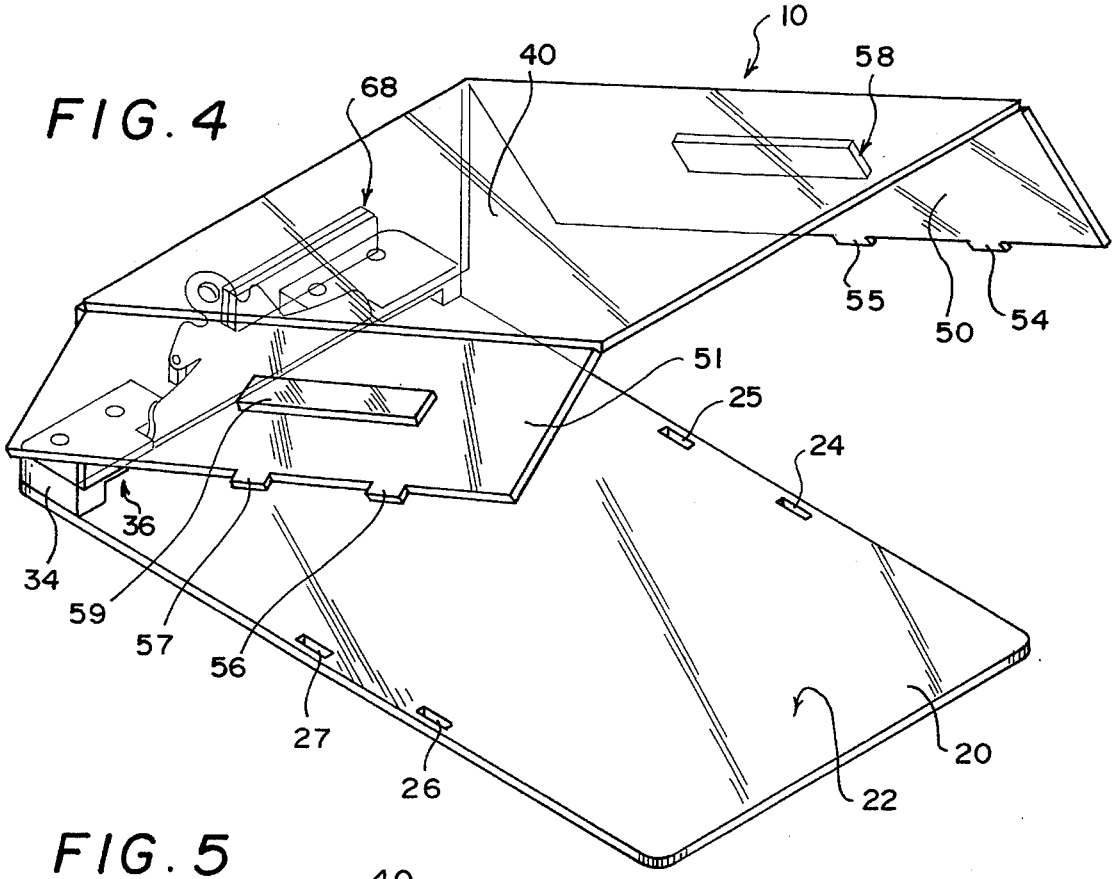
FIG. 5
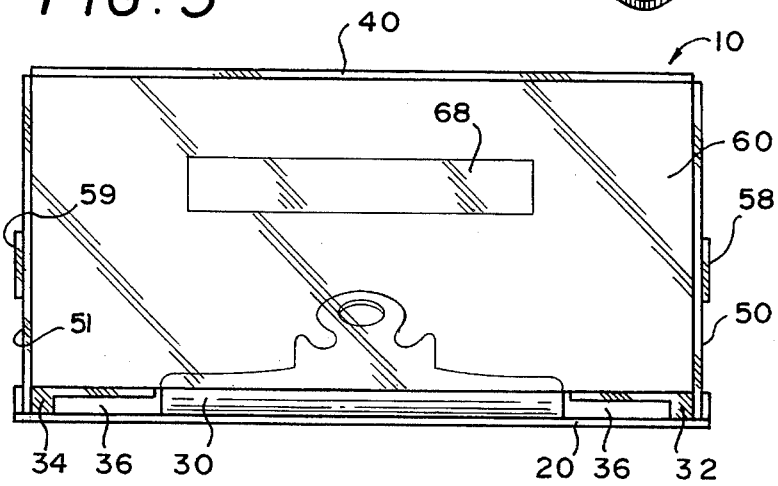
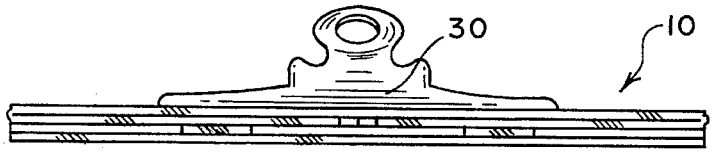
FIG. 6
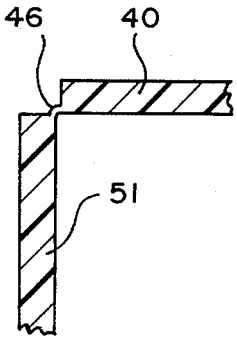
FIG. 7

COLLAPSIBLE ALL-WEATHER CLIPBOARD ASSEMBLY

BACKGROUND OF THE INVENTION

1. Field of the Invention

This invention is generally directed to clipboards, and, more particularly, to a clipboard which can be conveniently used in all weather conditions.

2. History of the Related Art

Clipboards typically comprise generally planar and rectangular boards constructed of plastic, wood or similar materials, to which a spring-biased clip is fixed near one end. Paper notepads and other writing media can be secured to the board and held in place by the clip. Clipboards are often used outdoors by police officers, meter readers, delivery makers, investigators, claims adjusters and many other professionals, as well as the general public. When using standard type clipboards during periods of inclement weather, it is often difficult to prevent the writing materials from becoming wet from rain and snow, as well as from becoming wind-blown.

In response, attempts have been made to create "all-weather" clipboards practical for use during inclement weather. Some of the known "all-weather" clipboards are bulky devices covered by generally transparent material. These known devices may be convenient during inclement weather, but are comparatively large, heavy and generally inconvenient to use during good weather.

Other inclement weather protective cover devices separable from a clipboard are also known. These devices typically require the carrying of at least two relatively large pieces.

U.S. Pat. No. 1,133,979 to Lee discloses a transparent shield which can be either permanently or removably attached to a clipboard. U.S. Pat. Nos. 1,642,384 and 1,642,385 to Pryor disclose rainy day tablet shields, as does U.S. Pat. No. 1,967,632 to Simonson.

U.S. Pat. No. 2,547,167 to Nielsen discloses an all-weather recording board.

U.S. Pat. No. 3,848,547 to Schaefer discloses a ballistic clipboard having an embodiment including a shield hinged to the ballistic clipboard to protect the contents during inclement weather conditions.

U.S. Pat. No. 4,445,728 to Bratton discloses an all-weather clipboard including a lamp.

U.S. Pat. No. 4,997,088 to Spry discloses a protective cover which is attachable to a clipboard to permit use of the clipboard for writing during inclement weather. The disclosed device can be removed from the clipboard and folded into a compact shape.

While the known devices are intended to allow clipboards to be used in inclement weather situations, none of the known devices is of a unitary construction which opens to a box-shaped structure for use during inclement weather and which collapses back down to a compact virtually-planar shape for use indoors and during good weather.

In view of the limitations and deficiencies associated with known clipboard constructions, and particularly those intended for use during inclement weather, there has been a need for a new clipboard construction conveniently suitable for use in all weather conditions.

SUMMARY OF THE INVENTION

The present invention has been made in view of the above-described and other limitations and deficiencies of the known devices and has as an object to provide a clipboard which is convenient for use in all weather conditions.

It is another object of the present invention to provide a clipboard which folds open to a box-like shape to provide a protective covering for containing writing materials during inclement or windy weather, and which collapses down to a compact and substantially planar shape for use indoors and during good weather.

The above and other additional objects and advantages of the present invention will become apparent from the detailed description which follows, considered in conjunction with the accompanying drawing figures.

To achieve the objects of the invention, the collapsible clipboard in accordance with a preferred embodiment of the invention is directed to an assembly which can be used in all weather conditions. The clipboard assembly provides a box-like inclement weather five-sided protective cover configuration for protecting writing media held by the board's clip, and a compact and generally planar collapsed configuration for use during good weather and indoors, and also for storage. When the all-weather clipboard assembly is in the inclement weather configuration, a top planar member covers the writing media from above, and one side of the protective cover is left open to provide access to any writing materials engaged by the clip. When the clipboard assembly is in the collapsed, good weather position, a pair of opposed walls of the protective cover fold under the top planar member, and an end wall folds down to form a new planar writing surface comprised of the top surface of the planar cover member and the outer surface of the end wall.

BRIEF DESCRIPTION OF THE DRAWINGS

In the accompanying drawings:

FIG. 1 is a perspective view from the left front of a collapsible all-weather clipboard assembly in accordance with a preferred embodiment of the present invention shown in an inclement-weather configuration and constructed in accordance with a preferred embodiment of the present invention;

FIG. 2 is a perspective view from the left front of the collapsible all-weather clipboard assembly of FIG. 1, shown in a collapsed good-weather configuration;

FIG. 3 is a partial side cross-sectional view of the collapsible all-weather clipboard assembly taken along line 3—3 in FIG. 2;

FIG. 4 is a perspective view from the left front of the collapsible all-weather clipboard assembly of FIGS. 1 and 2, shown between the collapsed good-weather configuration and the inclement weather configuration;

FIG. 5 is an end plan view of the collapsible all-weather clipboard of FIGS. 1–4, shown in the inclement weather configuration;

FIG. 6 is an end elevational view of the collapsible all-weather clipboard of FIGS. 1–5, shown in the collapsed good-weather configuration; and FIG. 7 is a partial cross-sectional elevational view of the collapsible all-weather clipboard assembly taken along line 7—7 in FIG. 1.

DETAILED DESCRIPTION OF THE PREFERRED EMBODIMENT

With reference to the drawings, FIGS. 1 through 7 illustrate a preferred embodiment of a collapsible clipboard assembly suitable for use in inclement weather and in good weather generally designated by reference numeral 10 in accordance with the present invention.

In FIG. 1, the collapsible all-weather clipboard assembly 10 is shown in a configuration ready for use during inclement weather. The clipboard assembly 10 is shown being held by an individual's left hand 12, while the individual's right hand 14 holds a writing instrument 16 such as a pen or pencil. While in the box-like shape of FIG. 1, the clipboard assembly 10 can be used to write on writing media (not shown), such as tablets of paper, while protecting the media from the effects of the bad weather.

The clipboard assembly 10 is comprised of a substantially planar base member 20 defining a planar upper writing surface 22. A spring-biased clip 30 is mounted near one end of the base member 20. As shown in FIG. 4, four slots, including a first right slot 24, a second right slot 25, a first left slot 26 and a second left slot 27, are provided in the base member 20.

Referring to FIG. 2, a right corner member 32 is fixed to the base member 20, preferably by means of a pair of screws 33. Similarly, a left corner member 34 is fixed to the base member 20, preferably by means of a pair of screws 35.

A substantially planar top cover member 40 defines a planar cover when the clipboard is in the box-like inclement weather position as shown in FIG. 1, and defines a writing surface 42 for use when the clipboard is in the collapsed position as shown in FIG. 2.

A right wall member 50 and an opposed left wall member 51 are hingedly attached to the top cover member 40, as can best be seen in FIG. 4. The right wall member 50 has a first right wall tab 54 and a second right wall tab 55, while the opposed left wall member 51 has a first left wall tab 56 and second left wall tab 57. A right wall support spacer 58 is fixed to the right wall member 50, while a left wall support spacer 59 is fixed to the left wall member 51.

A back wall member 60 defines a partial writing surface 62 (see FIG. 3) in the collapsed configuration. One edge of the back wall member 60 is hingedly attached to the right and left corner members 32 and 34. The opposite side of the back wall member is hingedly attached to the top cover member 40. A back wall support spacer 68 is fixed to the back wall member 60.

As best shown in FIGS. 4 and 5, the two corner members 32 and 34 define a slot means 36 for receiving a portion of writing media, such as paper, such that the writing media can slide in and out while the clip 30 is open, providing weather protection for the paper.

In accordance with the invention, different types of hinges can be used for the clipboard. The invention is shown in the Figs., particularly FIG. 7, having co-extruded clear-plastic "living" hinges 46. However, other types of hinges may be utilized including, for example, strong tape or metal or plastic materials fixed or fastened to the respective members by means of screws or adhesives or any other effective fastener or fasteners. The hinges may optionally be formed by one or more planar clear sheets of material bonded to, or alternatively coextruded with, the various members of the clipboard assembly.

The clip 30 is preferably fixed to the base 20 by means of two or more screws (not shown). Other means for mounting the clip to the clipboard are also within the scope of the invention.

Also, one or more air holes (not shown) can be provided in the clipboard assembly to ventilate the interior of the clipboard "box" so as to prevent the transparent members of the invention from fogging up. The air holes are preferably located in the side walls 50 and 51, since the side walls 50 and 51 never function as a writing surface.

A novel aspect of the present invention is the ability of the device to be propped open into a box-shaped configuration for use during inclement weather and also to be collapsed down to a relatively planar configuration for use during good weather. The collapsible all-weather clipboard 10 of the present invention is simple to use, as is described below.

In order to take up as little space as necessary, the clipboard 10 is usually stored in the collapsed configuration as shown in FIG. 2. If the weather is good, or if the clipboard 10 is to be used indoors, the clipboard 10 is simply kept in this flat, collapsed configuration. Writing media (not shown) (e.g. paper and/or notepads) are placed over the top surface 42 and the surface 62, and the clip 30 is opened to enable the writing media to be clamped in place.

In a situation where the clipboard 10 is to be used outdoors during inclement weather (e.g. rain, snow or wind), the writing media is removed and the all-weather clipboard 10 is manually opened from the collapsed configuration in which the side walls 50 and 51 are substantially parallel to the base member 20 as shown in FIG. 2 to the inclement weather configuration shown in which the side walls 50 and 51 are substantially perpendicular to the base member as shown in FIG. 1. FIG. 4 shows the all-weather clipboard assembly 10 between the inclement weather configuration and the collapsed configuration. To open the clipboard assembly 10 into the inclement weather position, the top cover member 40 is lifted upward away from base member 20. As the cover member 40 is lifted, it tends to shift rearward toward the clip 30, and the right wall member 50 and the left wall member 51 drop down, as the back wall 60 rises up. Once the opposed right and left wall members 50 and 51 have fully dropped down such that they are approximately parallel to each other and perpendicular to the top cover member 40, the first and second right wall tabs 54 and 55, as well as the first and second left wall tabs 56 and 57 are inserted into the first and second right slots 24 and 25 and the first and second left slots 26 and 27, respectively. The tabs in the respective slots hold the assembly in place, enabling the cover member 40, right and left wall members 50 and 51 and back wall 60 to form a box-shaped protective cover. The writing media can then be reinserted into the box-shape and can be written upon utilizing the support of planar writing surface 22. Other suitable means for engagement may be utilized instead of the preferred tabs and slots.

The clip 30 is positioned behind the back wall 60, outside of the box-shape and thus remains directly accessible for opening and closing without having to awkwardly reach into the box-shape. A slot 36 is formed underneath both the right and left corner members 32 and 34 to allow writing media to slide through the box-shape and under the opened clip 30, enabling the clip to grasp the writing media. While the all-weather clipboard assembly is in the inclement weather position, writing media is protected from above and from three of the four sides by the top planar member 40 and by the right, left, and end walls respectively. The fourth side is left open to give access to any writing media held by the clip 30.

While many different materials could be used to construct the clipboard assembly 10 of the present invention, transparent plastic material is preferably used for most or all of the various parts of the clipboard. For example, all of the planar members, the screws, the clip, and the hinges can all be composed of clear plastic material. However, if nonplastic parts are used, the materials should preferably be resistant to the effects of water, to enable the clipboard 10 to be used in rain and the like. For example, if clip 30 is constructed from metal, it is preferably a water-resistant metal such as stainless steel or aluminum. If wood is used for any of the planar members, the wood is preferably treated to also be water-resistant.

While any suitable construction materials can be utilized for most of the parts, it is important that at least the top covering member 40 be composed of a substantially transparent material to enable an individual to see writing materials contained when the clipboard is in the inclement weather configuration. The top member 40 is preferably spaced about four and a half inches above and parallel to the base 20.

The all-weather clipboard assembly 10 can be quickly and easily collapsed to the compact good weather position by simply lifting the cover assembly such that the tabs 54, 55, 56, and 57 are pulled out of the respective slots 24, 25, 26 and 27, and then tucking the left and right side walls 50 and 51 under the cover member 40 and sliding the cover member 40 down until it is adjacent to the base member 20. The cover member 40 tends to move in the direction away from the clip 30 as it is lowered. The right wall support spacer 58, the left wall support spacer 59 and the back wall support spacer 68 each rest against the top surface (i.e., the writing surface 22 in the inclement weather position) of the base 20 such that the collapsed clipboard assembly 10 is substantially planar. Spacing means other than the support spacers may alternatively be used to maintain the planar shape. A writing surface is formed by the combination of the top surface 42 of the planar cover member 40 and the outer surface 62 of the end wall 60 to form a new clipboard writing surface utilizing the same clip 30.

While the present invention has been described as part of a permanent clipboard construction, the present invention may be constructed as a removable cover for a standard clipboard. In such instances, the collapsible cover preferably remains on the clipboard for use in all weather situations, although it may be removed from the clipboard if desired.

The foregoing description of the preferred embodiments of the invention has been presented to illustrate the principles of the invention and not to limit the invention to the particular embodiments illustrated. It is intended that the scope of the invention be defined by all of the embodiments encompassed within the following claims, and their equivalents.

I claim:

1. A clipboard assembly suitable for use in inclement weather and in good weather, comprising:

a substantially planar base member providing a first writing surface for use in inclement weather;

a spring-biased clip mounted at an end of said planar base member;

a substantially planar end wall member hingedly mounted to said end of said planar base member;

a substantially planar top member having an end hingedly joined to said end wall member;

a first side wall hingedly joined to a first side of said top member;

a second side wall hingedly joined to a second side of said top member opposite to said first side;

engaging means for engaging said first and said second side walls with said base member, the engaging means being engageable to maintain each of said first and said second side walls in a perpendicular orientation, and said top member in a parallel spaced relationship, relative to said base member in an inclement weather configuration, and the engaging means being disengageable to form a substantially planar shaped collapsed configuration; and spacing means for maintaining a substantially planar shape in the collapsed configuration, said substantially planar end wall member and said substantially planar top member form a substantially contiguous planar second writing surface for use in good weather, said second writing surface being spaced from and substantially parallel to said first writing surface in the collapsed configuration.

2. The clipboard assembly of claim 1 wherein said clip is mounted such that in both the inclement weather configuration and the collapsed configuration, said clip is directly accessible.

3. The clipboard assembly of claim 1 further comprising spacing means provided on said first and said second side walls and said end wall member for maintaining a parallel spaced relationship relative to said base member in the collapsed configuration.

4. The clipboard of claim 3 wherein said spacing means is a plurality of members fixed to said first and said second side walls and to said end wall member.

5. The clipboard assembly of claim 4 wherein said clip is mounted such that in both the inclement weather configuration and the collapsed configuration, said clip is directly accessible.

6. The clipboard assembly of claim 5 further comprising a means disposed at said end of said base member for receiving a portion of writing media positioned on said base member in the inclement weather configuration.

7. The clipboard assembly of claim 1 further comprising a means disposed at said end of said base member for receiving a portion of writing media positioned on said base member in the inclement weather configuration.

8. The clipboard of claim 1 wherein said first and said second side walls are substantially perpendicular to said base member in the inclement weather configuration and substantially parallel to said base member in the collapsed configuration.

9. The clipboard of claim 1, wherein said engaging means comprises a plurality of tabs protruding from a face of each of said first and said second side walls and a plurality of slots formed in said base member, each of the tabs being received in a slot in the inclement weather configuration.

10. The clipboard of claim 1, wherein said top member is composed of a substantially clear plastic material.

11. A clipboard assembly suitable for use in inclement weather and in good weather, comprising:

a substantially planar base member;

a spring-biased clip mounted at an end of said planar base member;

a substantially planar end wall member hingedly attached to said end of said planar base member;

a substantially planar top member composed of a substantially transparent material and having an end hingedly joined to said end wall member;

a first side wall hingedly joined to a first side of said top member;

a second side wall hingedly attached to a second side of said top member;

engaging means for engaging said first and said second side walls with said base member; and spacing means;

the clipboard assembly being alternately configurable between a substantially planar first configuration in which said side walls are disengaged from and substantially parallel to said base member and in which a surface of said end wall member and a surface of said top member form a substantially contiguous second writing surface, said spacing means maintaining a substantially planar shape in the planar first configuration, said second writing surface being spaced from and substantially parallel to said substantially planar base member in the planar first configuration, and a box-shaped second configuration in which said side walls are engaged with and substantially perpendicular to said base member in which said substantially planar base member provides a first writing surface substantially protected from the inclement weather.

12. The clipboard assembly of claim 11 wherein said clip is mounted such that in both the first and second configurations, said clip is directly accessible.

13. The clipboard assembly of claim 11 further comprising spacing means provided on said first and said side walls and said end wall member for maintaining a parallel spaced relationship relative to said base member in the first configuration.

14. The clipboard of claim 13 wherein said spacing means is a plurality of members fixed to said side walls and to said end wall member.

15. The clipboard assembly of claim 14 wherein said clip is mounted such that in both the first and second configurations, said clip is directly accessible.

16. The clipboard assembly of claim 11 further comprising a means disposed at said end of said base member for receiving a portion of writing media positioned on said base member in the second configuration.

17. The clipboard assembly of claim 15 further comprising a means disposed at said end of said base member for receiving a portion of writing media positioned on said base member in the second configuration.

18. The clipboard of claim 11 wherein said first and said second side walls are substantially perpendicular to said base member in the second configuration and substantially parallel to said base member in the first configuration.

19. The clipboard of claim 11, wherein said engaging means comprises a plurality of tabs protruding from a face of each of said first and said second side walls and a plurality of slots formed in said base member, each of the tabs being received in a slot in the second configuration.

20. A cover assembly for use in a clipboard having a planar base which provides a writing surface and which has a spring-biased clip at one end thereof, the cover assembly comprising:

a substantially planar end wall member hingedly mountable to the end of the planar base member;

a substantially planar top member having an end hingedly joined to said end wall;

a first side wall hingedly joined to a first side of said top member;

a second side wall hingedly joined to a second side of said top member opposite to said first side; and engaging means for engaging said first and said second side walls with the base member, the engaging means being engageable to maintain each of said side walls in a perpendicular orientation, and said top member in a parallel spaced relationship, relative to the base member in an inclement weather configuration, and the engaging means being disengageable to form a substantially planar shaped collapsed configuration in which a surface of said end wall member and a surface of said top member form a substantially contiguous new writing surface; and spacing means for maintaining a substantially planar shape in the collapsed configuration, said substantially planar end wall member and said substantially planar top member form a substantially contiguous planar second writing surface for use in good weather, and said second writing surface being spaced from and substantially parallel to said first writing surface in the collapsed configuration.

* * * * *